United States Patent [19]

Pai et al.

[11] Patent Number: 4,504,564

[45] Date of Patent: Mar. 12, 1985

[54] METHOD FOR THE PREPARATION OF PHOTOCONDUCTIVE COMPOSITIONS

[75] Inventors: Damodar M. Pai, Fairport; Darlyn F. Pochan; John M. Pochan, both of Ontario, all of N.Y.

[73] Assignee: Xerox Corporation, Stamford, Conn.

[21] Appl. No.: 567,719

[22] Filed: Jan. 3, 1984

[51] Int. Cl.[3] ..... G03G 5/14

[52] U.S. Cl. ..... 430/132; 430/127; 430/59

[58] Field of Search ..... 430/127, 130, 132

[56] References Cited

U.S. PATENT DOCUMENTS 3,265,496 8/1966 Fox .
3,615,415 10/1971 Gramza .
3,946,129 3/1976 Jones ..... 428/304
4,123,271 10/1978 Fushida et al. .
4,265,990 5/1981 Stolka et al. ..... 430/59

*Primary Examiner*—Roland E. Martin
*Attorney, Agent, or Firm*—Peter H. Kondo

[57] ABSTRACT

An electrophotographic imaging member is produced by providing a photoconductive layer and depositing thereon a solution of polycarbonate and substituted N,N'-diphenyl-N,N'-bis(alkyl phenyl)-[1,1'-biphenyl]-4,4' diamine in a halogenated hydrocarbon solvent and a halogen-free organic solvent having a boiling point greater than the boiling point of the halogenated hydrocarbon solvent to provide a charge transport layer when solvents are removed.

10 Claims, No Drawings

METHOD FOR THE PREPARATION OF PHOTOCONDUCTIVE COMPOSITIONS

BACKGROUND OF THE INVENTION

This invention relates in general to electrophotography and more specifically, to a novel method of preparing an electrophotographic imaging member.

In the art of electrophotography an electrophotographic imaging member containing a photoconductive insulating layer is imaged by first uniformly electrostatically charging its surface. The member is then exposed to a pattern of activating electromagnetic radiation such as light, which selectively dissipates the charge in the illuminated areas of the photoconductive insulating layer to form an electrostatic latent image. This latent image may then be developed to form a visible image by depositing finely divided electroscopic marking particles on the surface of the photoconductive insulating layer.

The photoconductive layer utilized in electrophotography may be a homogeneous single layer such as vitreous selenium or it may be a composite layer containing a photoconductor and other material. One type of composite photoconductive layer used in electrophotography is illustrated U.S. Pat. No. 3,121,006 which describes a number of layers comprising finely divided particles of a photoconductive inorganic compound dispersed in an electrically insulating organic resin binder. In its present commercial form, the binder layer contains particles of zinc oxide, uniformly dispersed in a resin binder and coated on a paper backing.

In the particular examples described in U.S. Pat. No. 3,121,006, the binder comprises a material which is incapable of transporting injected charge carriers generated by the photoconductive particles for any significant distance. As a result, with the particular material disclosed, the photoconductive particles must be, in substantially continuous particle-to-particle contact throughout the layer in order to permit the charge dissipation required for cyclic operation. Therefore, with the uniform dispersion of photoconductive particles described, a relatively high volume concentration of the photoconductor, about 50 percent by volume, is usually necessary in order to obtain sufficient photoconductive particle-to-particle contact for rapid discharge. However, it has been found that high photoconductive loadings in the binder results in the physical continuity of the resin being destroyed, thereby significantly reducing the mechanical properties of the binder layer. Systems with high photoconductive loadings are often characterized as having little or no flexibility. On the other hand, when the photoconductor concentration is reduced appreciably below about 50 percent by volume, the photoinduced discharge rate is reduced, making high speed cyclic or repeated imaging difficult or impossible.

U.S. Pat. No. 3,037,861 to Hoegl et al teaches that poly(N-vinylcarbazole) exhibits some long-wavelength UV sensitivity and suggests that its spectral sensitivity can be extended into the visible spectrum by the addition of dye sensitizers. The Hoegl et al patent further suggests that other additives such as zinc oxide or titanium dioxide may be used in conjunction with poly(N-vinylcarbazole). In the Hoegl et al patent the poly(N-vinylcarbazole) is intended to be used as a photoconductor, with or without additive material which extend its spectral sensitivities.

In addition to the above, certain specialized layers particularly designed for reflex imaging have been proposed. For example, U.S. Pat. No. 3,165,405 to Hoesterey utilizes a two-layered zinc oxide binder structure for reflex imaging. The Hoesterey patent utilizes two separate contiguous photoconductive layers having different spectral sensitivities in order to carry out a particular reflex imaging sequence. The Hoesterey device utilizes the properties of multiple photoconductive layers in order to obtain the combined advantages of the separate photoresponse of the respective photoconductive layers.

It can be seen from a review of the conventional composite photoconductive layers cited above, that upon exposure to light, photoconductivity in the layered structure is accomplished by charge transport through the bulk of the photoconductive layer, as in the case of vitreous selenium (and other homogeneous layered modifications). In devices employing photoconductive binder structures which include inactive electrically insulating resins such as those described in U.S. Pat. No. 3,121,006, conductivity or charge transport is accomplished through high loadings of the photoconductive pigment and allow particle-to-particle contact on the photoconductive particles. In the case of photoconductive particles dispersed in a photoconductive matrix, as illustrated in U.S. Pat. No. 3,121,007, photoconductivity occurs through the generation and transport of charged carriers in both the photoconductive matrix and the photoconductive pigment particles.

Although the above patents rely upon distinct mechanisms of discharge through the photoconductive layer, they generally suffer from common deficiencies in that the photoconductive surface during operations is exposed to the surrounding environment, and particularly in the case of repetitive xerographic cyclic operation, where these photoconductive layers are susceptible to abrasion, chemical attack, heat and multiple exposure to light. These effects are characterized by a gradual deterioration of the electrical characteristics of the photoconductive layer resulting in the printing out of surface defects and scratches, which are localized areas of persistant conductivity which fail to retain an electrostatic charge.

In addition to the problems noted above, these photoreceptors require that the photoconductive comprise either 100 percent of the layer, as in the case of the vitreous selenium layer, or that they preferably contain a high proportion of photoconductive material in the binder configuration. The requirements of the photoconductive layer containing all or a major portion of a photoconductive material further restricts the physical characteristics of the final plate, drum or belt in that the physical characteristics such as flexibility and adhesion of the photoconductor to a supporting substrate are dictated by the physical properties of the photoconductor, and not by the resin or matrix material which is preferably present in a minor amount.

Another form of a composite photosensitive layer which has been considered by the prior art includes a layer of photoconductive material which is covered with a relatively thick plastic layer and coated on a supporting substrate.

U.S. Pat. No. 3,041,166 to Bardeen describes such a configuration in which a transparent plastic material overlies the layer of vitreous selenium on a supporting substrate. In operation, the free surface of the transparent plastic layer is electrostatically charged to a given polarity. This device is then exposed to activating radiation which generates a hole electron pair in the photoconductive layer. The electrons move through the plastic layer and neutralize positive charges on the free surface of the plastic layer thereby creating an electrostatic image. Bardeen, however, does not teach any specific plastic material which will function in this manner, and confines his examples to structures which use a photoconductor material for the top layer.

U.S. Pat. No. 3,598,582 describes a special purpose composite photosensitive device adapted for reflex exposure by polarized light. One embodiment which employs a layer of dichroic organic photoconductive particles arrayed and oriented on a supporting substrate and a layer of poly(N-vinylcarbazole) formed over the oriented layer of dichroic material. When charged and exposed to light polarized perpendicular to the orientation of the oriented layer, the oriented dichroic layer and poly(N-vinylcarbazole) layer are both sustantially transparent to the initial exposure light. When the polarized light strikes a white background of the document being copied, the light is de-polarized, reflected back through the device and absorbed by the dichroic photoconductive material. In another embodiment, the dichroic photoconductor is dispersed in oriented fashion through the layer of poly(N-vinylcarbazole).

Belgium Pat. No. 763,540, issued Aug. 26, 1971, discloses an electrophotographic member having at least two electrically operative layers. The first layer comprises a photoconductive layer which is capable of photogenerating charge carriers and injecting the photogenerated holes into a contiguous active layer. The active layer comprises a transparent organic material which is substantially non-absorbing in the spectral region of intended use, but which is "active" in that it allows injection of photogenerated holes from the photoconductive layer, and allows these holes to be transported through the active layer. The active polymers may be mixed with inactive polymers or nonpolymeric material.

Gilman, Defensive Publication Ser. No. 93,449, filed Nov. 27, 1970 published 8/8/8 OG 707 on July 20, 1970, Defensive Publication P888.013, discloses that the speed of an inorganic photoconductor such as amorphous selenium can be improved by including an organic photoconductor in the electrophotographic element. For example, an insulating resin binder may have $TiO_2$ dispersed therein or may be a layer of amorphous selenium. This layer is overcoated with a layer of electrically inactive binder resin having an organic photoconductor such as 4,4'-bis(diethylamino)-2,2'-dimethyltriphenylmethane dispersed therein.

"Multi-Active Photoconductive Element", Martin A. Burwick, Charles J. Fox and William Light, Research Disclosure, Vol. 133; pages 38–43, May 1975, was published by Industrial Opportunities Limited, Homewell, Havant Hampshire, England. This disclosure relates to a photoconductive element having at least two layers comprising an organic photoconductor containing a charge transport layer in electrical contact with an aggregate charge generation layer. Both the charge generation layer and the charge transport layer are essentially organic compositions. The charge generation layer contains a continuous, electrically insulating polymer phase and a discontinuous phase comprising a finely divided, particulate, cocrystalline complex of (1) at least one polymer having an alkylidene diarylene group and a recurring unit and (2) at least one pyrylium-type dye salt. The charge transport layer is an organic layer which is capable of transporting injected charge carries of the charge generation layer. This layer may comprise an insulating resinuous material having 4,4'-bis(diethylamino)-2,2'-dimethyltriphenylmethane dispersed therein.

U.S. Pat. No. 3,265,496 discloses that N,N,N',N'-tetraphenylbenzidene may be used as photoconductive material in electrophotographic elements. This compound is not sufficiently soluble in the resin binders of the instant invention to permit a sufficient rate of photoinduced discharge.

Straughan, U.S. Pat. No. 3,312,548 in pertinent part, discloses a xerographic plate having a photoconductive insulating layer comprising a composition of selenium, arsenic and a halogen. The halogen may be present in amounts from about 10 to 10,000 parts per million. This patent further discloses a xerographic plate having a support, a layer of selenium and an overlayer of photoconductive material comprising a mixture of vitreous selenium, arsenic and halogen.

U.S. Pat. No. 3,265,496 is directed to an electrophotographic element comprising an electrically conductive support having coated thereon a photoconductive composition containing as the photoconductive substance, a polyfunctional tertiary amine selected from the group consisting of certain polytriphenylamines, poly-p-aminostyrenes, N,N,N',N'-tetraphenylbenzidenes and N,N,N',N'-tetraphenylenediamines. The photoconductive composition may be employed in a photoconductive layer with or without a binder. Numerous binders are described including polycarbonates. In addition, solvents of choice for coating compositions in U.S. Pat. No. 3,265,496 include benzene, toluene, acetone, 2-butanone, chlorinated hydrocarbons, e.g. methylene chloride, ethylene chloride, etc., ethers, e.g. tetrahydrofuran, or mixtures of these solvents, etc.

U.S. Pat. No. 3,615,415 pertains to a method of forming a heterogeneous photoconductive composition comprising the steps of dissolving in an organic solvent a pyrylium dye and polymeric material having an alkylidene diarylene moiety in the recurring unit, shearing the solution, forming a coating of the sheared solution and drying the coating to form a heterogeneous composition comprising a continuous phase of the polymeric material and a discontinuous phase of the combination of the dye and polymeric material. The polymeric material may be polycarbonates and polythiocarbonates, polyvinylethers, polyesters, polyalpha-olefins, phenolic resins and the like. Liquids useful as solvents for preparing coating solutions include a number of organic solvents such as aromatic hydrocarbons like benzene and toluene, ketones like acetone and ethylmethyl ketone, halogenated hydrocarbons like methylene chloride and ethylene chloride, furans like tetrahydrofurans, alkyl and aryl alcohols like methyl alcohol, ethyl alcohol and benzyl alcohol, as well as mixtures of such solvents.

U.S. Pat. No. 4,123,271 is directed to a process for the preparation of a photosensitive material which includes applying to a conductive substrate a coating composition prepared by adding a solution of alkli metal dichromate and a polar solvent of methanol or ethanol, to a composition of finely divided zine oxide and an electrically insulating organic synthetic resin binder in an aromatic solvent which is toluene and xylene. The polar solvent and aromatic solvent are miscible with each other with the resin binder being dissolved in the aromatic solvent and the dichromic compound being soluble in the polar solvent.

U.S. Pat. No. 3,946,129 relates to a process for preparing reprographic sheets for use in electrostatography. In this method, a coating composition is applied to a substrate, generally paper, out of a solution of a mixture of mutually miscible organic liquids, one being a solvent for the polymer and the other a non-solvent for the polymer and removing the organic liquids with most of the solvent being removed before a significant amount of non-solvent is removed.

U.S. Pat. No. 4,265,990 discloses a photosensitive member having photoconductive layer and a contiguous charge transport layer. The charge transport layer comprises a polycarbonate resin containing from about 25–75 percent by weight of one or more of a compound having the general formula:

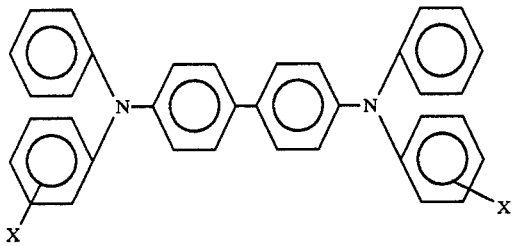

wherein X is selected from the group consisting of an alkyl group having from 1 to about 4 carbon atoms, e.g. methyl, ethyl, propyl, butyl, etc., and chlorine in the ortho, meta or para position. The diamine compound is applied to the photoconductive layer in a solution with polycarbonate resin and methylene chloride solvent.

OBJECTS OF THE INVENTION

It is an object of this invention to provide a novel process for preparation of an electrophotographic imaging member which overcomes the above-noted disadvantages.

It is another object of this invention to reduce the content of halogenated solvents in charge transport layers.

It is another object of this invention to provide a novel method for the preparation of an electrophotographic imaging member having stable electrical properties during extended use.

SUMMARY OF THE INVENTION

The foregoing objects and others are accomplished in accordance with this invention by providing a process for the preparation of an electrophotographic imaging member comprising providing a photoconductive layer, depositing on the photoconductive layer a coating comprising a solution of a polycarbonate resin, a diamine compound having the general formula:

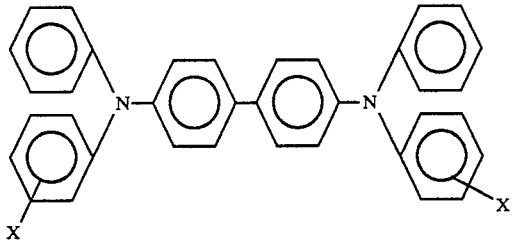

wherein X is selected from the group consisting of an alkyl group having from 1 to about 4 carbon atoms, and chlorine, a halogenated hydrocarbon solvent and a halogen-free organic solvent having a boiling point greater than the boiling point of the halogenated hydrocarbon solvent, the weight ratio of the halogen-free organic solvent to halogenated solvent being between about 1:99 and about 50:50, and heating the coating to remove at least substantially all the halogenated hydrocarbon solvent. The polycarbonate resin preferably has a molecular weight of from about 20,000 to about 120,000. The coating preferably contains from about 25 to about 75 percent by weight of the diamine compound based on the total weight of the polycarbonate resin and the diamine compound.

The compound may be named N,N'-diphenyl-N,N'-bis(alkylphenyl)-[1,1'-biphenyl]-4,4'-diamine wherein the alkyl group is for example, methyl, ethyl, propyl, n-butyl, etc., or the compound may be N,N'-diphenyl-N,N'-bis(chlorophenyl)-[1,1'-biphenyl]-4,4'-diamine.

The active coating, i.e. the charge transport layer, is substantially non-absorbing to visible light or radiation in the region of intended use but is "active" in that it allows the injection of photogenerated holes from the photoconductive layer, i.e. charge generation layer, and allows these holes to be transported through the active charge transport layer to selectively discharge a surface charge on the outer imaging surface of the active layer.

When the diamines of the instant invention are dispersed in a polycarbonate binder, this layer transports charge very efficiently without trapping charges when subjected to charge/light discharge cycles in an electrophotographic mode. There is no buildup of residual potential over many thousands of cycles.

Moreover, the transport layers comprising the above diamines dispersed in a polycarbonate binder have a sufficiently high glass transition temperature (Tg) even at high loadings thereby eliminating the problems associated with low Tg.

Furthermore, no deterioration of charge transport was observed when these transport layers are subjected to ultraviolet radiation encountered in its normal usage of the xerographic machine environment.

"Electrically active" when used to define active layers means that the material is capable of supporting the injection of photogenerated holes from the generating material and capable of allowing the transport of these holes through the active layer in order to discharge a surface charge on the active layer.

"Electrically inactive" when used to describe the organic material which does not contain any diamine means that the material is not capable of supporting the injection of photogenerated holes from the generating material and is not capable of allowing the transport of these holes through the material.

One embodiment of a layered configuration member comprises a supporting substrate, such as a metalized plastic member, containing a photoconductive member thereon. For example, the photoconductive layer may be in the form of amorphous or trigonal selenium or alloys of amorphous selenium such as selenium-arsenic, selenium-tellurium-arsenic and selenium-tellurium. A charge transport layer of electrically inactive polycarbonate resinous material having dispersed therein from about 25 percent to about 75 percent by weight of the diamine is coated over the selenium photoconductive layer. Generally, a thin interfacial layer or blocking layer is sandwiched between the photoconductive layer and the substrate. The barrier layer may comprise any suitable electrically insulating material such as metallic oxide or organic resin. The use of the polycarbonate resin containing the diamine allows placement of a photoconductive layer adjacent to a supporting substrate and physically protecting the photoconductive layer with a top surface which will allow transport of photogenerated holes from the photoconductor. This structure can then be imaged in a conventional electrographic process which normally includes charging, exposure to activating radiation in image configuration, development and transfer.

It should be understood that the polycarbonate resinous material which becomes electrically active when it contains from about 25 to about 75 percent by weight of the diamine does not function as a photoconductor in the wavelength region of intended use. The hole electron pairs are photogenerated in the photoconductor layer and the holes are then injected into the active layer and hole transport occurs through this active layer.

When an alloy of selenium and arsenic containing a halogen is used as a charge carrier generation layer in a multilayered device which contains a contiguous charge carrier transport layer containing polycarbonate resin and a diamine, higher contrast potentials may be achieved compared to similar multilayered members using different generator layer materials. For example, a comparison is made between a 60 micron thick single layer photoreceptor member containing 64.5 percent by weight amorphous selenium, 35 percent by weight arsenic, and 800 parts per million iodine and a multilayered member having a 0.2 micrometer thick charge generation layer, 35.5 percent by weight arsenic, 64.5 percent by weight amorphous selenium, and 850 parts per million iodine overcoated with a 30 micrometer thick charge transport layer of Makrolon®, a polycarbonate resin, having dispersed therein 40 percent by weight N,N'-diphenyl-N,N'-bis(3-methylphenyl)-[1,1'-biphenyl]-4,4'-diamine.

The charge generation layer may comprise photoconductive particles dispersed randomly in an electrically insulating resin. Alternatively, the charge generator may comprise photoconductive particles in the form of continuous chains through the thickness of a binder material. The chains can constitute a multiplicity of interlocking photoconductive continuous paths through the binder material. The photoconductive paths are present in a volume concentration of from about 1 to about 25 percent based on the volume of the charge generator layer. Instead of photoconductive particles dispersed randomly in an electrically insulating resin, the charge generator layer may comprise a homogeneous photoconductive layer. If desired, a blocking layer may be interposed between the substrate and photoreceptor interface. The blocking layer functions to prevent the injection of charge carriers from the substrate into the photoconductive layer. Any suitable blocking layer may be used. Typical blocking layer materials include Nylon, epoxy resin, aluminum oxide and the like.

The substrate may be of any suitable conductive material. Typical conductive materials include aluminum, steel, brass, graphite, dispersed conductive particles, conductive polymers and the like. The substrate may be rigid or flexible and of any conventional thickness. Typical substrate configurations include flexible belts or sleeves, sheets, webs, plates, cylinders, drums and the like. The substrate may also comprise a composite structure such as a shaped organic resin substrate coated with a thin conductive layer such as aluminum or copper iodide or a glass substrate coated with a thin conductive coating of chromium or tin oxide. Particularly preferred substrates are metalized polyesters such as aluminized Mylar.

In addition, if desired, an electrically insulating substrate may be used. In this case, the charge may be placed upon the insulating member by double corona charging techniques well known and disclosed in the prior art. Other modifications using an insulating substrate or no substrate at all including placing the imaging member on a conductive backing member or plate during charging of the surface while in contact with the backing member. Subsequent to imaging, the imaging member may then be stripped from the conductive backing.

Any suitable organic or inorganic photoconductive materials or mixtures thereof may be used in the generator layer. Typical inorganic materials include inorganic crystalline photoconductive compounds and inorganic photoconductive glasses. Typically inorganic compounds include cadmium sulfoselenide, cadmium selenide, cadmium sulfide and mixtures thereof. Typical inorganic photoconductive glasses include amorphous selenium and selenium alloys such as selenium-tellurium, selenium-tellurium-arsenic, and selenium-arsenic and mixtures thereof. Selenium may also be used in a crystalline form known as trigonal selenium.

Typical organic photoconductive materials include phthalocyanine pigment such as the X-form of metal-free phthalocyanine described in U.S. Pat. No. 3,357,989 to Byrne et al; metal phthalocyanine such as copper phthalocyanine; quinacridones available from duPont under the tradename Monastral Red, Monastral Violet, and Monastral Red Y; substituted 2,4-diamino-triazines disclosed by Weinberger in U.S. Pat. No. 3,445,227; triphenoxdioxazines disclosed by Weinberger in U.S. Pat. No. 3,442,781; polynuclear aromatic quinones available from Allied Chemical Corporation under the tradename Indofast DD Scarlet, Indofast Violet Lake B, Indofast Brillant Scarlet and Indofast Orange.

Intermolecular charge transfer complexes such as a mixture of poly(N-vinylcarbazole) and trinitrofluorenone may be used as charge generating materials. These materials are capable of injecting photogenerated holes into the transport material.

Additionally, intramolecular charge transfer complexes may be used as charge generating materials capable of injecting photogenerated holes into the transport materials.

The preferred generator material is trigonal selenium. A method of making a positive imaging device utilizing trigonal selenium comprises vacuum evaporating a thin layer of vitreous selenium onto a substrate, forming a relatively thicker layer of electrically active organic material over the selenium layer followed by heating the device to an elevated temperature, e.g. 120° C. to 210° C. for a sufficient time, e.g. 1–24 hours, to convert the vitreous selenium to the crystalline trigonal form. Another method of making a photosensitive member which utilizes trigonal selenium comprises forming a dispersion of finely divided vitreous selenium particles in a liquid organic resin solution, applying the solution as a coating onto a supporting substrate and drying the coating to form a binder layer comprising vitreous selenium particles contained in an organic resin matrix. The member is then heated to an elevated temperature, e.g. 100° C. to 140° C. for a sufficient time, e.g. 8–24 hours, to convert the vitreous selenium to the crystalline trigonal form. Similarly, finely divided trigonal selenium particles dispersed in an organic resin solution can be coated onto a substrate and dried to form a generater binder layer.

Another preferred embodiment is a 0.2 micron thick charge generation layer of 35.5 percent by weight arsenic, 64.5 percent by weight amorphous selenium, and 850 parts per million iodine. This charge generation layer may be overcoated with a 30 micron thick charge transport layer of Makrolon ®, a polycarbonate resin which has dispersed therein 40 percent by weight of the diamine.

The above list of photoconductors should in no way be taken as limiting, but merely as illustrative as suitable materials. The size of the photoconductive particles is not particularly critical. Satisfactory results are obtained with particles in a size range of about 0.01 to about 5.0 micrometers.

The binder material for the photoconductive particles may comprise any electrically insulating resin such as those described in the above-mentioned Middleton et al U.S. Pat. No. 3,121,006. When the binder is an electrically inactive or insulating resin, it is essential that there be particle-to-particle contact between the photoconductive particles. This necessitates that the photoconductive material be present in an amount of at least about 10 percent by volume of the binder layer with no limitation of the maximum amount of the photoconductor in binder layer. If the matrix or binder comprises an active material, the photoconductive material need only be present in an amount of about 1 percent or less by volume of the binder layer with no limitation of the maximum amount of the photoconductor in binder layer. The thickness of the photoconductive layer is not critical. Layer thicknesses from about 0.05 to about 20.0 micrometers have been found satisfactory with a preferred thickness of about 0.2 to about 5.0 micrometers yielding good results.

Another embodiment is where the photoconductive material may be particles of amorphous selenium-arsenic-halogen which may comprise from about 0.5 percent to about 50 percent by weight arsenic and the halogen may be present in amounts from about 10 to about 10,000 parts per million with the balance being selenium. The arsenic preferably may be present from about 20 percent to about 40 percent by weight with about 35.5 percent by weight being the most preferred. The halogen preferably is iodine, chlorine or bromine. The most preferred halogen is iodine. The remainder of the alloy or mixture is preferably selenium.

The active layer comprises a transparent electrically inactive polycarbonate resinous material having dispersed therein from about 25 percent to about 75 percent by weight of one or more of the diamines defined above. In general, the thickness of the active layer is between about 5 microns to about 100 microns. However, thicknesses outside this range can also be used.

The preferred polycarbonate resins for the transport layer have a molecular weight from about 20,000 to about 120,000, more preferably from about 50,000 to about 120,000. The materials most preferred as the electrically inactive resinous material are poly(4,4'-isopropylidene diphenylene carbonate) having molecular weights of from about 25,000 to about 40,000, available as Lexan ®145 and from about 40,000 to about 45,000 available as Lexan 141, both from the General Electric Company, and from about 50,000 to about 120,000 available as Makrolon ®, from Farbenfabriken-Bayer A.G.; and from about 20,000 to about 50,000, available as Merlon ®, from Mobay Chemical Company.

The active layer is non-absorbing to light in the wavelength region employed to generate carriers in the photoconductive layer. This preferred range for xerographic utility is from about 4,000 Angstrom units to about 8,000 Angstrom units. In addition, the photoconductor should be responsive to all wavelengths from 4,000 Angstrom units to about 8,000 Angstrom units if a panchromatic response is required. All photoconductor-active material utilized in the instant invention result in the injection and subsequent transport of holes across the physical interface between the photoconductor and the active material. The active layer, i.e. charge transport layer should be transparent so that most of the incident radiation is utilized by the charge generator layer for efficient photogeneration. The active transport layer employed in conjunction with the photoconductive layer of the instant invention is a material which is an insulator to the extent that the electrostatic charge placed on the active transport layer is not conducted in the absence of illumination, i.e. generate sufficient to prevent formation and retention of an electrostatic latent image thereon and subsequently exposed to activating illumination and image configuration.

Halogenated solvent are employed to dissolve the components of the charge transport layer to facilitate intimate mixing of the diamine compound and the polycarbonate binder. Typical halogenated solvents include methylene chloride, ethylene chloride, trichloromethane, carbon tetrachloride, and the like having a boiling point of between about 42° C. and about 80° C. When a halogenated solvent is employed to dissolve the components of the charge transport layer, a residual amount of the halogenated solvent remains in the charge transport layer after drying. This residual amount of halogenated solvent causes the charge transport layer to become excessively electrically conductive when the dried charge transport layer is exposed to ultraviolet radiation such as that encountered in ambient room light. Since halogenated solvents provide the most desired degree of intimate mixing of the transport layer components, use of these solvents are desirable if means can be devised to counteract the undesirable effects of ultraviolet radiation degradation. Techniques for reducing this effect include the addition of chemical species to quench or alter the photochemical pathway of degradation. Another method of eliminating residual halogenated solvent is to incorporate a high temperature ($>T_g$) heating cycle during photoreceptor fabrication.

In other words, the drying temperature would exceed $T_g$ for a sufficient time to permit solvent mobility and diffusion. Unfortunately, time constraints render this approach impractical. However, by employing a halogen free solvent having a higher boiling point than the halogenated solvent to artificially lower the $T_g$ of the transport layer, thermal cycling of the transport layer during drying to a given temperature can achieve a higher degree of heating above the artificially lowered $T_g$ thereby leading to higher diffusion constants and less solvent retention. The presence of the halogen free solvent in the charge transport layer does not adversely affect the conductivity of the transport layer exposed to ultraviolet radiation.

Any suitable halogen free solvent may be employed so long as it has a higher boiling point than the halogenated solvent. Typical halogen free solvents include tetrahydrofuran, toluene, xylene, dimethoxyethane and the like having a boiling point of between about 64° C. and about 140° C. Preferably, the halogen free solvent has a boiling point at least about 10° C. greater than the halogenated solvent with which it is used because during the course of drying, the lower boiling solvent will be the first to escape and this escape of the lower boiling halogenated solvent is facilitated by the presence of the higher boiling halogen free solvent. Satisfactory results may be obtained when the weight ratio of halogen free solvent to halogenated solvent is between about 1:99 and about 50:50. For optimum results, the weight ratio of halogen free solvent to halogenated solvent should be between about 10:90 and about 25:75. The lower limit for the halogen free solvent is determined by its effectiveness in reducing the $T_g$ of the layer when it is present in the layer and the upper limit for the halogen free solvent is determined by solubility considerations.

In general, the thickness of the active layer preferably is from about 5 micrometers to about 100 micrometers, but thicknesses outside this range can also be used. The ratio of the thickness of the active layer, i.e. charge transport layer, to the photoconductive layer, i.e. charge generator layer, preferably should be maintained between about 2:1 to 200:1 and in some instances as great as 400:1.

The following examples further specifically define the present invention with respect to the method of making the photosensitive member. Parts and percentages are by weight unless otherwise indicated. The examples below, other than the control examples, are intended to illustrate various preferred embodiment of the instant invention.

EXAMPLE I

An aluminized polyester film, Mylar® available from duPont, is coated with a thin polyester adhesive layer (duPont 49,000 available from duPont). A layer having a thickness of about 0.5 micrometer of amorphous selenium was then vapor deposited on the adhesive polyester layer by conventional vacuum deposition techniques such as those described by Bixby in U.S. Pat. No. 2,753,278 and U.S. Pat. No. 2,970,906.

The charge transport layer was prepared by dissolving about 0.3 gram of polycarbonate resin (Makrolon® available from Farbenfabriken Bayer A.G.) and 0.2 gram of N,N'-diphenyl-N,N'-bis(3-methylphenyl)-[1,1'-biphenyl]-4,4'-diamine in 3 milliliters of methylene chloride. This mixture was coated onto the amorphous selenium layer using a Bird Film Applicator. The coating was then vacuum dried to 40° C. for 16 hours forming 25 micron thick dry layer of charge transport material. The resulting layer device was negatively charged to a potential of about −1,200 and the dark decay monitored for about 5 seconds. The dark decay was found to be about 100 volts in 5 seconds. This device was then exposed to a 2 microsecond flash having a wavelength of 4,330 Angstrom units in about a 15 ergs/cm$^2$ intensity. The device was completely discharged by the light source indicating that it is capable of xerographic use to form visible images.

The ultraviolet light stability of this device was tested by first exposing the device to ambient laboratory light from conventional fluorescent ceiling lights for 45 hours and retested by negatively charging and monitoring the dark decay. The dark decay of the device increased significantly (1,000 volts in 5 seconds) as a result of the exposure to ambient ultraviolet light.

EXAMPLE II

The procedures of Example I were repeated except that transport layer was prepared by dissolving 0.3 gram of polycarbonate resin (Makrolon available from Farbenfabriken Bayer A.G) and 0.2 gram of N,N'-diphenyl-N,N'-bis(3-methylphenyl)-[1,1'-biphenyl]-4,4'-diamine in a mixture of 2.7 milliliters of methylene chloride and 0.3 milliliters of tetrahydrofuran. This transport layer mixture was applied to the generator layer described in Example I with a Bird Film Applicator and dried in the same manner as the transport layer of Example I to form a dried layer having a thickness of about 25 microns.

The resulting device was negatively charged and exposed in the same manner described in Example I. The dark decay was found to be about 100 volts in 5 seconds. The device of this example was also completely discharged by the light source.

The ultraviolet light stability of the device was then tested to exposure to ambient laboratory light for 45 hours and retested by negatively charging and monitoring the dark decay. The dark decay of the device increased by only 100 volts 5 seconds. This is a significant improvement over the performance of the device of Example I.

EXAMPLE III

The procedures of Example I were repeated except that transport layer was prepared by dissolving 0.3 gram of polycarbonate resin (Makrolon available from Farbenfabriken Bayer A.G) and 0.2 gram of N,N'-diphenyl-N,N'-bis(3-methylphenyl)-[1,1'-biphenyl]-4,4'-diamine in a mixture of 2.7 milliliters of methylene chloride and 0.3 milliliters of toluene. This transport layer mixture was applied to the generator layer described in Example I with a Bird Film Applicator and dried in the same manner as the transport layer of Example I to form a dried layer having a thickness of about 25 microns.

The resulting device was negatively charged and exposed in the same manner described in Example I. The dark decay of the device increased by only 100 volts 5 seconds. The device of this example was also completely discharged by the light source.

The ultraviolet light stability of the device was then tested to exposure to ambient laboratory light for 45 hours and retested by negatively charging and monitoring the dark decay. The dark decay of the device increased by only 40 volts in 5 seconds. This is a significant improvement over the performance of the device of Example I.

EXAMPLE IV

Transport compositions having the formulations described in Examples I, II and III were applied to Ball grained aluminum substrates and vacuum dried at ($10^{-3}$ mmHg) at 40° C. for 16 hours. The dielectric spectra of the coatings of samples A, B, C were recorded as a function of temperature, (20° C. and 130° C.) Film A exhibited large peaks near 50° C. which indicated entrapped methylene chloride. In samples B and C, only a normal plasticized Tg was observed at about 330° C. No methylene chloride peaks were observed. On thermally cycling samples B and C to 120° C. at a rate of 1° per minute, the excess solvent was removed and the samples exhibited dielectric structure associated with a well dried sample cast from methylene chloride alone. The reduced methylene chloride results in increased photochemical stability. The stabilization effect is not due to a cation quenching effect of the added solvent because neither tetrahydrofuran nor toluene exhibit any quenching effect.

EXAMPLE V

The procedures of Example I were repeated except that the transport layer was prepared by dissolving 0.3 gram of polycarbonate resin (Makrolon available from Farbenfabriken Bayer A.G.) and 0.2 gram of N,N'-diphenyl-N,N'-bis(3-methylphenyl)-[1,1'-biphenyl]-4,4'-diamine in a mixture of 2.7 milliliters of methylene chloride and 0.3 milliliters of 1,2 dichloroethane. This transport layer mixture was applied to the generator layer described in Example I with a Bird Film applicator and dried in the same manner as the transport layer of Example I to form a dried layer having a thickness of about 25 micrometers.

The resulting device was negatively charged and exposed in the same manner described in Example I. The dark decay was found to be about 100 volts in 5 seconds. The device of this example was also completely discharged by the light source. The ultraviolet stability of the device was then tested by exposure to ambient laboratory light for 45 hours and retested by negatively charging and monitoring the dark decay. The dark decay of the device increased significantly (1000 volts in 5 seconds) as a result of the exposure to ambient ultraviolet light. There was no improvement over the device of Example I.

EXAMPLE VI

The procedures of Example I were repeated except that the transport layer was prepared by dissolving 0.3 gram of polycarbonate resin (Makrolon available from Farbenfabriken Bayer A.G.) and 0.2 gram of N,N'-diphenyl-N,N'-bis(3-methylphenyl)-[1,1'-biphenyl]-4,4'-diamine in a mixture of 1.4 milliliters of methylene chloride and 1.4 milliliters of tetrahydrofuran. The transport mixture appears translucent indicating phase separation. This transport layer mixture was applied to the generator layer described in Example I with a Bird Film applicator and dried in the same manner as the transport layer of Example I to form a dried layer having a thickness of about 25 micrometers.

The resulting device was negatively charged and exposed in the same manner described in Example I. The device of this example was not completely discharged by the light source. A residual potential of 100 volts shows the effect of phase separation-trapping in the transport layer.

Although the invention has been described with reference to specific preferred embodiments, it is not intended to be limited thereto, rather those skilled in the art will recognize that variations and modifications may be made therein which are within the spirit of the invention and within the scope of the claims.

We claim:

1. A process for the preparation of an electrophotographic imaging member comprising providing a photoconductive layer, depositing on said photoconductive layer a coating comprising a solution of a polycarbonate resin material having a molecular weight of from about 20,000 to about 120,000, from about 25 to about 75 percent by weight of a diamine compound based on the total weight of said polycarbonate resin, said diamine compound of one or more compounds having the general formula:

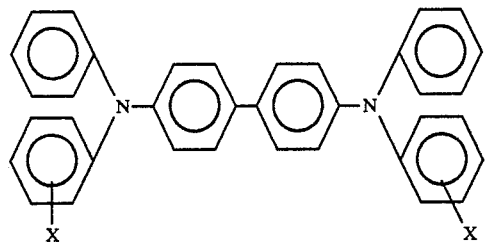

wherein X is selected from the group consisting of an alkyl group, having from 1 to about 4 carbon atoms and chlorine, a halogenated hydrocarbon solvent and a halogen free organic solvent having a boiling point greater than the boiling point of said halogenated hydrocarbon solvent, the weight ratio of said halogen free organic solvent to said halogenated hydrocarbon solvent being between about 1:99 and about 50:50, heating said coating to remove at least substantially all of said halogenated hydrocarbon solvent, said photoconductive layer exhibiting the capability of photogeneration of holes and injection of said holes and said charge transport layer being substantially non-absorbing in the spectral region at which the photoconductive layer generates and injects photogenerated holes but being capable of supporting the injection of photogenerated holes from said photoconductive layer and transporting said holes through said charge transport layer.

2. A process for the preparation of an electrophotographic imaging member in accordance to claim 1 wherein said boiling point of said halogen free organic solvent is between about 64° C. and 110° C. and is also at least about 10° C. greater than said boiling point of said halogenated hydrocarbon solvent and said boiling point of said halogenated hydrocarbon solvent is between about 42° C. and 80° C.

3. A process for the preparation of an electrophotographic imaging member in accordance to claim 1 wherein the weight ratio of said halogen free organic solvent to said halogenated hydrocarbon solvent is between about 10:90 and about 25:75.

4. A process for the preparation of an electrophotographic imaging member in accordance to claim 1 wherein said halogenated hydrocarbon solvent is methylene chloride.

5. A process for the preparation of an electrophotographic imaging member in accordance to claim 1 wherein said halogen free organic solvent is tetrahydrofuran.

6. A process for the preparation of an preparation of an electrophotographic imaging member in accordance to claim 1 wherein said polycarbonate resin is poly(4,4'-isopropylidene-diphenylene carbonate).

7. A process for the preparation of an electrophotographic imaging member in accordance to claim 6 wherein said polycarbonate resin has a molecular weight of from about 25,000 to about 45,000.

8. A process for the preparation of an electrophotographic imaging member in accordance to claim 6 wherein said polycarbonate resin has a molecular weight of from about 50,000 to about 120,000.

9. A process for the preparation of an electrophotographic imaging member in accordance to claim 6 wherein said photoconductive layer is amorphous selenium, trigonal selenium, or amorphous selenium alloys selected from the group consisting of selenium-tellurium selenium-tellurium-arsenic and mixtures thereof.

10. A process for the preparation of an electrophotographic imaging member in accordance to claim 1 wherein said photoconductive layer is amorphous selenium, trigonal selenium, or amorphous selenium alloys selected from the group consisting of selenium-tellurium, selenium-tellurium-arsenic and mixtures thereof.

* * * * *